United States Patent [19]

Mattson

[11] 4,337,743

[45] Jul. 6, 1982

[54] THROTTLE PEDAL FEEDBACK APPARATUS FOR ECONOMICAL ENGINE OPERATION

[75] Inventor: Richard W. Mattson, Rossford, Ohio

[73] Assignee: Eltra Corporation, Toledo, Ohio

[21] Appl. No.: 67,970

[22] Filed: Aug. 20, 1979

Related U.S. Application Data

[63] Continuation of Ser. No. 824,755, Aug. 15, 1977, abandoned.

[51] Int. Cl.[3] ..... F02D 11/08

[52] U.S. Cl. ..... 123/396; 123/389; 123/342

[58] Field of Search ..... 123/103 E, 103 B, 103 R, 123/396, 389, 342

[56] References Cited

U.S. PATENT DOCUMENTS

| | | | |
|---|---|---|---|
| 2,782,025 | 2/1957 | Olson | 123/103 E |
| 3,237,527 | 3/1966 | Martin | 123/103 E |
| 4,029,475 | 4/1977 | Nuss | 123/103 E |
| 4,089,307 | 5/1978 | Nakamura | 123/103 E |
| 4,128,087 | 12/1978 | Hayashi | 123/103 E |

*Primary Examiner*—Ronald H. Lazarus

*Attorney, Agent, or Firm*—James P. DeClercq; Robert E. Greenstien; Joel I. Rosenblatt

[57] ABSTRACT

An apparatus is disclosed whereby a sudden perceptible resistance is applied to the accelerator pedal of an automobile vehicle when the intake manifold vacuum pressure level decreases below a preselected pressure. A pneumatic motor is operated by a throttle valve that mixes the ambient and manifold vacuum. The motor controls the relative position of a helical spring relative to the throttle control and allows the throttle control and spring to engage abruptly when the manifold vacuum pressure is below the preselected level and withdraws the spring from contact with the throttle control when the manifold vacuum pressure exceeds that pressure level.

2 Claims, 3 Drawing Figures

THROTTLE PEDAL FEEDBACK APPARATUS FOR ECONOMICAL ENGINE OPERATION

This is a continuation, of application Ser. No. 824,755 Filed. Aug. 15, 1977 now abandoned.

BACKGROUND OF THE INVENTION

This invention relates to internal combustion engines and more precisely to an apparatus for maintaining economical and efficient operation of such engines during acceleration.

Many automobile drivers depress the accelerator pedal much too far when accelerating with the result being that more engine power is used than is necessary for normal economical acceleration and there is excessive fuel consumption. For some time now it has been known that it is desireable to provide a means for the average driver to save fuel by warning him that the vehicle is being operated in this uneconomical manner. A major disadvantage of such systems is that a visual or audible indication has been supplied which is not necessarily detected by the operator of the vehicle. Other related devices have attempted to provide pedal resistance to prevent unnecessary opening of the engine throttle, but generally, these provide a progressive resistance and not a definite, automatic indication to the vehicle operator that operation is entering the uneconomical range.

It is an object of the present invention, therefore, to provide a device which warns the operator of the engine, without audible or visible means, and therefore without distraction, that engine operation is preceding into the uneconomical range.

SUMMARY OF THE INVENTION

In the apparatus according to the present invention this object as well as additional objects are achieved by using the dynamic intake manifold vacuum to control a pneumatic motor which controls the relative position of a coil spring with the respect to the throttle control. At the point of inefficient engine operation, that is when the vacuum is below the desired range, the throttle control and spring are engaged; the operator feels a thump on the accelerator pedal, and further depression or movement of the throttle will require additional pressure to overcome the spring tension. Static positioning of the throttle control along with increased engine operation producing increasing vacuum will remove the spring tension from the throttle control.

A further understanding of the present invention as well as other benefits, objects and attributes thereof, will become apparent from the following detailed description and claims wherein:

DETAILED DESCRIPTION

Figure 1:
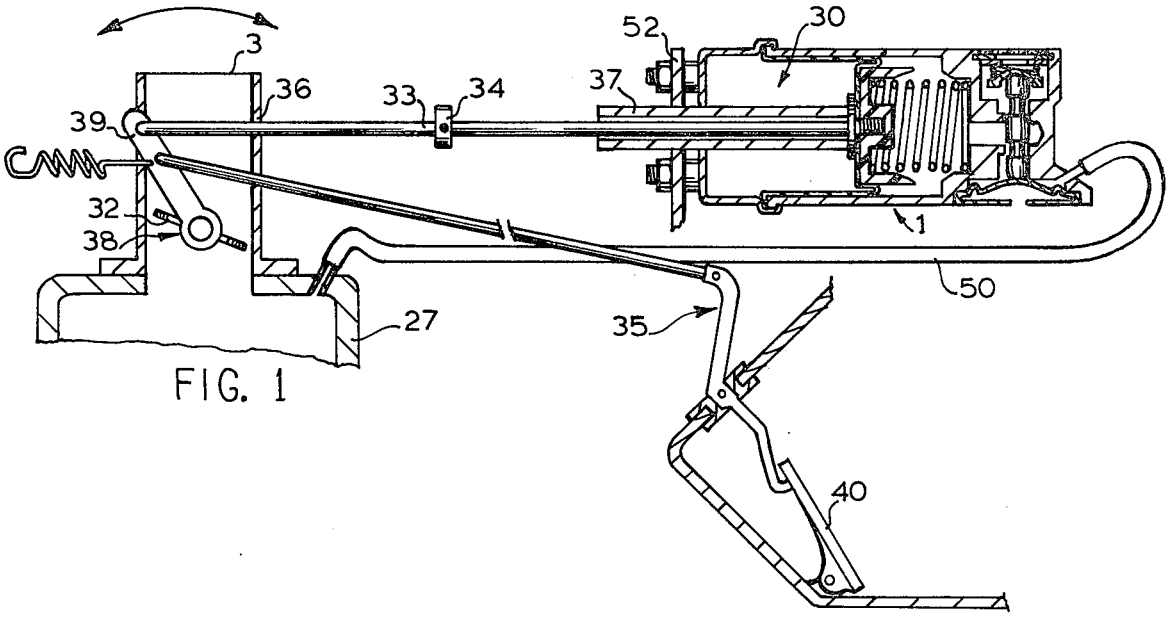
FIG. 1 shows the present invention connected to pedal operated throttle control, connected to a carburetor apparatus mounted on an intake manifold of an internal combustion engine.
Figure 2:
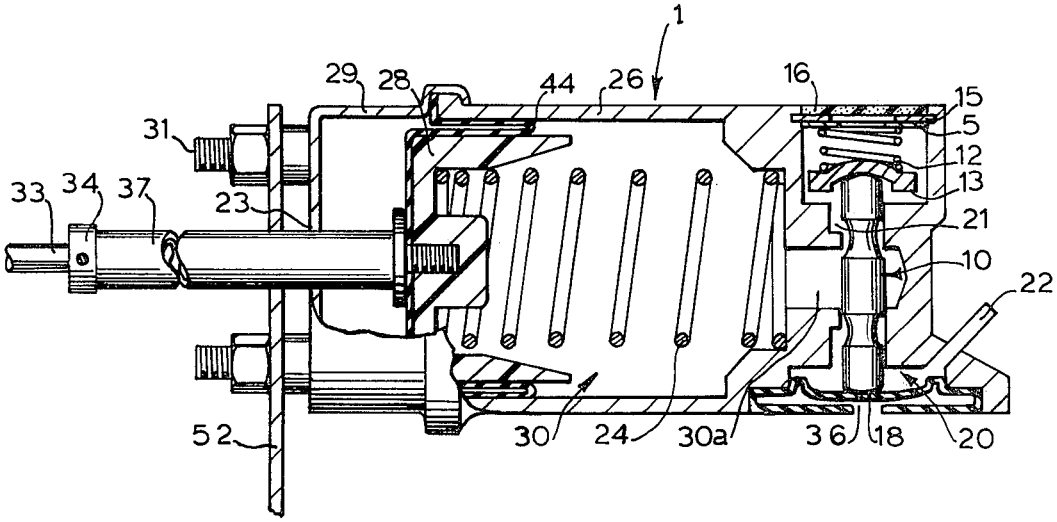
FIG. 2 is a cutaway view of the preferred embodiment of the present invention, which depicts its operational position when the intake manifold vacuum is below a preselected level for efficient engine operation.

Referring to FIG. 1, a carburetor, shown as 36, is mounted on an intake manifold 27, and contained within carburetor 36 there is a carburetor butterfly valve 32 that rotates within the carburetor throat 3 in response to the movement of control arm 39, linkage 35, and accelerator pedal 30. Connected to control arm 39 is linkage 33, upon which there is mounted an adjustable stop 34. Linkage 33 slides within the tubular member 37 that extends out from the pneumatic motor 1. Motor 1, as stated below, responds to the intake manifold vacuum applied through a vacuum line 50. A mounting bracket 52 is attached to motor 1 to facilitate mounting it on the engine.

Motor 1 can be seen to comprise a cylindrical body 26 upon which is mounted an end cap 39 through which tubular member 37 passes. Attached to one end of member 39 is a piston 28, and a rolling diaphragm 44 that separates the piston and cap 39 to seal the interface between the piston and body 26, while allowing the piston to slide within the body. Disposed between the piston and wall 25 of body 26 is a coil spring 24 which urges piston 24 outward to contact cap 29.

A valve assembly is located in the opposite end of body 26 and throttles the vacuum level within the interior chamber 30 of motor 1. As set forth below, piston 28 moves within body 26 in response to vacuum level in chamber 30. The valve assembly includes a valve 10 that moves up and down in a vertical direction to control (throttle) the flow between chambers 20 & 21 and chamber 30 by way of bore **30*a*. Chamber 20 is connected by way of the previously described line 50 to intake manifold 27, and located at the lower end of valve 10 is a flexible diaphragm 18 which responds to the pressure gradient between chamber 20 and the ambient through vent 36 to move valve 10 in the vertical direction. At the opposite end of valve 10 is a calibrated control spring 12, which urges valve 10 in the vertical direction opposing diaphragm 18. A seat 13 is provided for spring 12 on the top of valve 10, and spring 12 is held in place by a split ring washer 15 that is radially contracted to fit within the adjacent slot in body 26, as shown. A spacing washer 5 is disposed between washer 15 and spring 12, for proper tensioning of spring 12**.

Valve 10 moves in the vertical direction in response to the vacuum level applied to inlet 20 from manifold 27, and as the vacuum level in inlet 20 increases, the pressure gradient across diaphragm 18 also increases whereby valve 10 is moved upward against spring 12. Naturally, the larger the vacuum level in inlet 20, the larger will be the vertical displacement of valve 10 against spring 12, and at a particular position in its vertical movement, valve 10 will initially open the path from chamber 30 to inlet 20 while the path from the ambient to chamber 30 from inlet 21 starts to close. However, as more vacuum is applied to inlet 20, valve 10 will be moved farther in the vertical direction and eventually the ambient path will be closed off. As a result of this, the vacuum level in chamber 30 will be a mixture of the ambient and manifold vacuum, except when the path from the ambient is closed off. And as detailed below, due to the action of valve 10, the vacuum in chamber 30 increases from ambient to the mixture level very rapidly as the valve moves.

Figure 3:
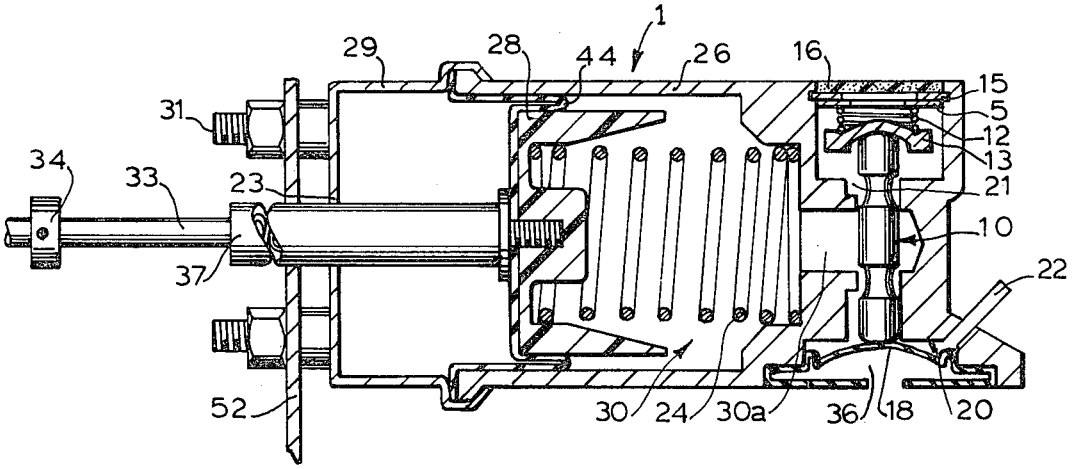
FIG. 3 is also a cutaway view showing the preferred embodiment of the present invention of FIG. 2, except it is shown in its operational position when the intake manifold vacuum is at least, at the level necessary for efficient operation.

To illustrate the operation of the device, it is assumed that uneconomical operation of the vehicle arises when the pedal is opened to a point at which the intake manifold vacuum level drops below 10.5 inches Hg., which, as noted earlier, is a significant reduction from the 14 inches Hg. that commonly occurs during low power operation, for example cruise and idle conditions. Spring 24, however, is first selected so that it will be compressed, as shown in FIG. 3, at such time as the vacuum within chamber 30 is slightly above 6 inches Hg., and in addition, spring 24 should be slightly compressed when cap 29 is inserted into body 26. For design purposes, the vacuum which is necessary in chamber 30 to compress spring 24 completely should be substantially less than the intake manifold vacuum level at which uneconomical operation is considered to occur. Since it is desired that the operator of the vehicle feel a thump in the accelerator pedal when the vacuum is less than 10.5 inches Hg., spring 12 is selected so as to allow valve 10 to move upward sufficiently when the vacuum level in inlet 20 is at least 10.5 inches Hg., whereby the communicating path from inlet 20 to chamber 30 will open. Once this path opens, the intake manifold vacuum is applied to chamber 30 and the vacuum level in the chamber will abruptly rise above 6 inches Hg. and thereby cause piston 28 to retract spring 24. Similarly, at such time that the vacuum drops below 10.5 inches, the communicating path from inlet 20 to chamber 30 will be closed substantially, if not completely blocked, and thereby substantially block the path from the intake manifold 20, and by reason of the ambient venting from inlet 21, the vacuum level in chamber 30 will abruptly drop substantially below 6 inches Hg. As a consequence of this, spring 24 will abruptly thrust piston 28 outward towards stop 34. It is to be emphasized that this sudden movement of piston 28 is a direct consequence of the operation of valve 10. At such time that valve 10 moves upward in response to the vacuum pressure in inlet 20, the path from the ambient through inlet 21 and into chamber 30 is simultaneously being closed, and thus, while valve 10 is moving upward, and opening the communicating path between inlet 20 and chamber 30, the vacuum level in chamber 20 is increasing. But at the same time, the venting path to the ambient is naturally decreasing, which allows the vacuum level in chamber 30 to rise more rapidly than it would if a static ambient vent path were maintained. Therefore, in essence there is a regenerative quality to the operation of valve 10, whereby a small change in manifold vacuum causes a dramatic change in the vacuum level in chamber 30, which accounts for the somewhat discontinuous movement of piston 28 in response to intake manifold vacuum level variations around the selected level of 10.5 inches Hg.

In view of the foregoing description, when the vehicle engine is idling, the intake manifold vacuum pressure level will be approximately 14 inches Hg. and accordingly piston 28 will have spring 24 substantially compressed as shown in FIG. 1. This is because the vacuum in chamber 30 is much greater than 6 inches Hg., as the vent path from inlet 21 will be completely closed when the manifold vacuum level is this high by reason of the resulting extreme vertical displacement of valve 10 against spring 12. At this time, there is no contact between stop 34 and the edge of member 37 and the vehicle operator is able to depress the accelerator pedal 40 without encountering any resistance from spring 24. If, however, pedal 40 is depressed down during an engine power demand sequence, for example, acceleration, and the vacuum level drops below the selected 10.5 inches Hg., as a result, the vacuum level in chamber 30 will drop below 6 inches Hg. in the manner set forth above and therefore, spring 24 will push piston 28 out until it contacts stop 34. By reason of this, the vehicle operator will feel a sudden bump in the pedal giving him a clear warning that pedal 40 has been depressed too far; that he is demanding unnecessary engine power for normal acceleration. Nevertheless, spring 24, however, does not restrict further depression of pedal 40, but instead, the operator, if necessary, can continue depressing the pedal, but to do this, will have to overcome the bias from spring 24 on the pedal.

If the operator momentarily holds pedal 40 in a static position so that stop 34 rests against member 33, the manifold vacuum level will slowly rise as the vehicle accelerates. As soon as the level exceeds 10.5 inches Hg., stop 34 and member 39 will disengage. But if at that time, the operator should depress the accelerator pedal down farther, to a position at which the vacuum level again drops below 10.5 inches Hg., stop 34 and the member 37 will again engage. In this manner, the above sequence is rapidly repeated to achieve sufficient, but economical acceleration.

While I have hereinabove described what is at present the preferred embodiment of my invention, it will be obvious to those skilled in the art that there are many possible modifications and variations which can be made thereto, but which are nevertheless equivalent thereto and embrace the true scope and spirit of my invention. Therefore, it is intended that the claims, hereinafter set forth, cover all such modifications, variations and equivalents.

I claim:

1. An apparatus adapted to provide a stepwise throttle control feedback to indicate operation of an internal combustion having an intake manifold at a vacuum level less than a first predetermined vacuum level in said intake manifold, comprising:

resistance means;

means for stepwise engaging said resistance means and said throttle control at a preselected relative position therebetween;

motor means for moving said resistance means;

control means responsive to said vacuum for controlling said motor to stepwise adjust the position of said resistance means;

said means for stepwise engaging including linkage means having a first section operably connected to said throttle control and a second section operably connected to said resistance means and movable therewith, said first section including stop means adapted to engage said second section;

said motor means being responsive to said control means;

said control means being operably connected to said intake manifold and being adapted to provide a said vacuum level of said intake manifold to said motor means when said vacuum of said intake manifold is above said first predetermined level, and being adapted to stepwise remove said substantially constant second vacuum level to said motor means when said vacuum of said intake manifold is below said first predetermined level;

said motor means including a piston slidably mounted in a chamber in a first body, said substantially constant second vacuum level being provided to a portion of said chamber between a first end thereof and said piston;

said resistance means including a spring disposed in said portion of said chamber between said first end and said piston;

said second section of said linkage means being connected to said piston;

said control means including a valve means disposed within said first body and having a first port connected to said intake manifold, a second port connected to an ambient atmospheric pressure and an output port connected to said portion of said chamber between said first end and said piston;

said valve means including a valve member adapted to operably connect said intake manifold to said portion of said chamber when said vacuum level is above said first predetermined vacuum level and to stepwise connect said ambient atmospheric pressure to said portion of said chamber when said vacuum level is below said first predetermined vacuum level;

said valve member being adapted to simultaneously close said first port and open said second port.

2. An apparatus according to claim 1, wherein:

said valve means includes a diaphragm disposed adjacent said first port for moving said valve member towards said second part to close said second port when said vacuum level of said intake manifold is above said first predetermined level;

and further includes a spring means disposed adjacent said second port to close said first port when said vacuum level is below said first predetermined level.

* * * * *